US008827751B1

(12) United States Patent
Lan et al.

(10) Patent No.: US 8,827,751 B1
(45) Date of Patent: Sep. 9, 2014

(54) ELECTRICAL CONNECTOR

(71) Applicant: Cheng Uei Precision Industry Co., Ltd., New Taipei (TW)

(72) Inventors: Rong-Qin Lan, Dong-Guan (CN); Ping-Chih Chen, New Taipei (TW); Yin-Lung Wu, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/872,050

(22) Filed: Apr. 26, 2013

(51) Int. Cl.
*H01R 24/28* (2011.01)
*H01R 13/516* (2006.01)

(52) U.S. Cl.
CPC ..... *H01R 13/516* (2013.01)
USPC ..... 439/660; 439/607.01

(58) Field of Classification Search
USPC ..... 439/660, 607, 35, 607.01, 607.54, 439/607.35, 345
See application file for complete search history.

(56) References Cited

U.S. PATENT DOCUMENTS 7,896,559 B2 * 3/2011 Yi et al. ..... 385/75
7,909,653 B1 * 3/2011 Wan et al. ..... 439/660
8,021,195 B2 * 9/2011 He et al. ..... 439/638
8,123,558 B2 * 2/2012 Su et al. ..... 439/607.01
8,147,276 B2 * 4/2012 Wang et al. ..... 439/660
8,303,329 B2 * 11/2012 Wu ..... 439/395
8,323,057 B2 * 12/2012 Ho ..... 439/660
8,439,691 B1 * 5/2013 Lan et al. ..... 439/79
8,568,172 B1 * 10/2013 Lan et al. ..... 439/607.4
2010/0290745 A1 * 11/2010 Liao et al. ..... 385/90
2011/0256764 A1 * 10/2011 Wu ..... 439/607.01
2011/0269322 A1 * 11/2011 He et al. ..... 439/78
2011/0269341 A1 * 11/2011 He et al. ..... 439/607.01
2012/0009818 A1 * 1/2012 Yao et al. ..... 439/607.23
2012/0021646 A1 * 1/2012 Su et al. ..... 439/607.01
2012/0052739 A1 * 3/2012 Wang et al. ..... 439/660

* cited by examiner

*Primary Examiner* — Briggitte R Hammond
(74) *Attorney, Agent, or Firm* — Cheng-Ju Chiang

(57) ABSTRACT

An electrical connector includes a supporting body, an insulating body engaged on the supporting body, a plurality of first terminals integrated in the insulating body, a plurality of second terminals integrated in the supporting body, and a shielding shell enclosing the supporting body and the insulating body. The first and the second terminals have contact portions thereof alternately arranged in two rows in longitudinal direction, and have soldering portions thereof vertically located with tail ends thereof projecting beyond a bottom face of the supporting body. The soldering portions are alternately arranged in two rows in longitudinal direction. The electrical connector of the present invention not only has high signal transmission rate and miniaturized structure, but also can be assembled quickly and accurately, thus it saves a lot of manpower and material resources, reduces the production cost and further improves the production efficiency.

10 Claims, 5 Drawing Sheets

ELECTRICAL CONNECTOR

BACKGROUND OF THE INVENTION

1. Field of the Invention

The present invention relates to an electrical connector, and more particularly to an electrical connector having high signal transmission rate.

2. The Related Art

Nowadays, electrical connectors are widely used in electronic products with the development of the electronic technology. And the electrical connector is required to be increasingly miniaturized and have high signal transmission rate. Conventionally, in order to have a high signal transmission rate, two or more traditional electrical connectors are pieced together. However, the pieced electrical connector often occupies a relatively large space so that cannot meet the requirement of miniaturization. Furthermore, the process of piecing together the traditional electrical connectors often need to take a great deal of manpower and material resources so that results in too high manufacture cost and lower productivity. So, an electrical connector having high signal transmission rate and miniaturized structure is required.

SUMMARY OF THE INVENTION

Accordingly, an object of the present invention is to provide an electrical connector. The electrical connector includes a supporting body, an insulating body, a plurality of first terminals, a plurality of second terminals and a shielding shell. The supporting body has a supporting portion and a tongue board protruding frontward from a front face of the supporting portion. A rear of the tongue board defines a plurality of containing slots arranged at regular intervals along a transverse direction and each extending to the front face of the supporting portion. A rear of the supporting portion is concaved frontward to form a second receiving cavity. A rear of the insulating body is concaved frontward to form a first receiving cavity. A plurality of first terminals each has a first fastening strip, a first contact portion and a first soldering portion which are connected with two opposite ends of the first fastening strip. A plurality of second terminals each has a second fastening strip, a second contact portion and a second soldering portion which are connected with two opposite ends of the second fastening strip. The shielding shell encloses the supporting body and the insulating body. The insulating body is engaged on the supporting portion of the supporting body. The first terminals are integrated in the insulating body by virtue of the first fastening strips being molded in the insulating body and arranged at regular intervals along the transverse direction. The second terminals are integrated in the supporting body by virtue of the second fastening strips being molded in the supporting body and arranged at regular intervals along the transverse direction. The first contact portions of the first terminals stretch in front of the insulating body and are received in the containing slots of the supporting body. The first soldering portions of the first terminals are vertically located in the first receiving cavity and behind the second receiving cavity with tail ends thereof further projecting beyond a bottom face of the supporting body. The second contact portions of the second terminals are exposed on the tongue board and alternately arranged in front of the first contact portions along the transverse direction. Front ends of the second contact portions are embedded in the tongue board. The second soldering portions of the second terminals are vertically located in the second receiving cavity with tail ends thereof further projecting beyond the bottom face of the supporting body. The first soldering portions and the second soldering portions are alternately arranged in two rows in longitudinal direction.

As described above, the electrical connector of the present invention not only has high signal transmission rate and miniaturized structure, but also can be assembled quickly and accurately, thus it saves a lot of manpower and material resources, reduces the production cost and further improves the production efficiency.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
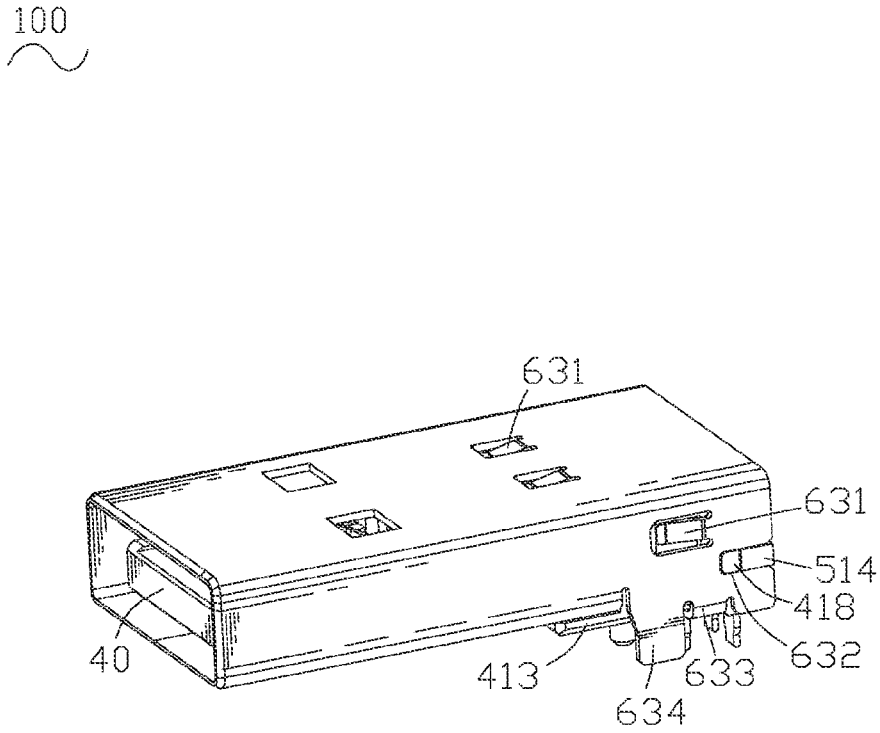
FIG. 1 is an assembled, perspective view of an electrical connector in accordance with an embodiment of the present invention.
Figure 2:
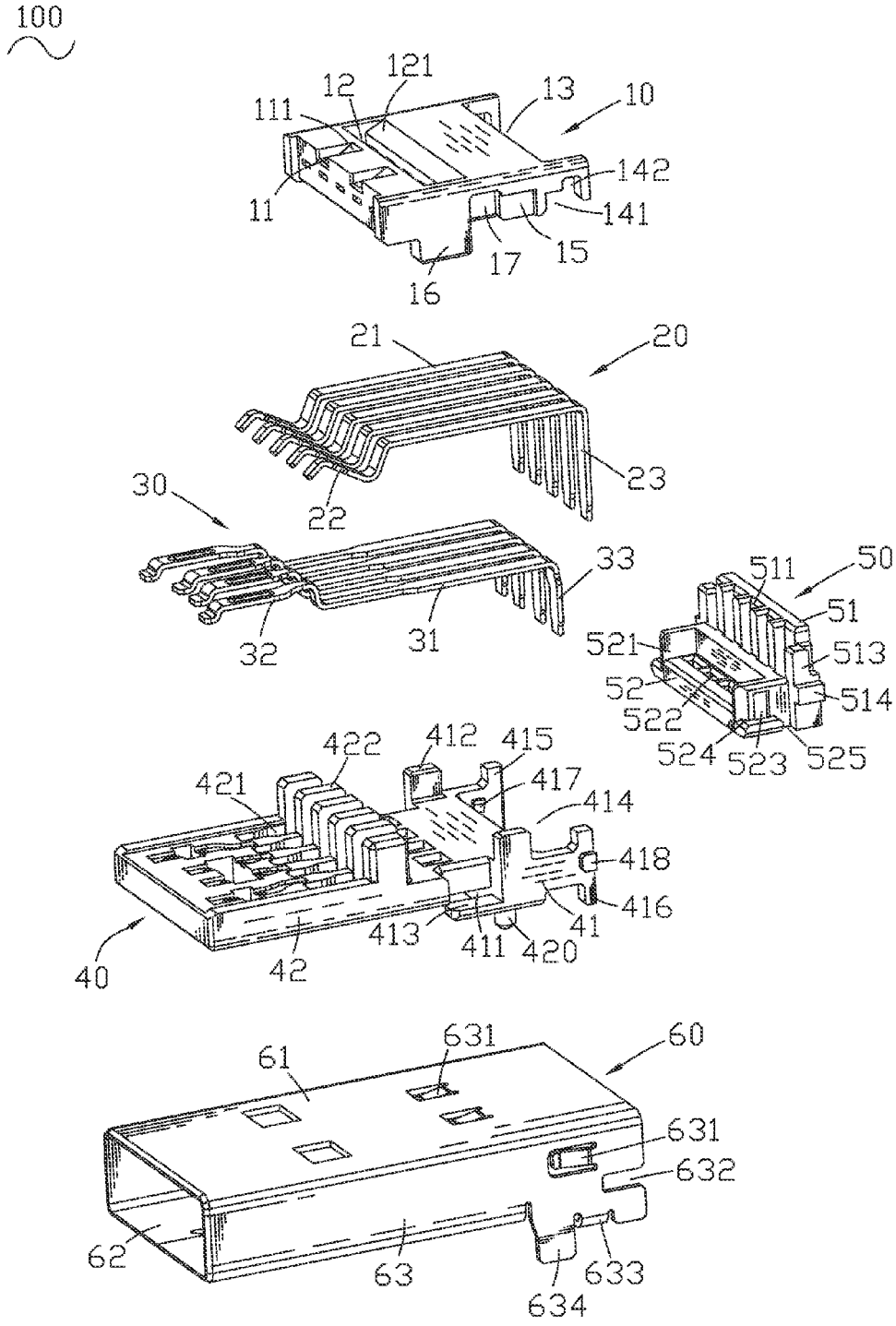
FIG. 2 is an exploded, perspective view of the electrical connector shown in FIG. 1.

Referring to the drawings in greater detail, and first to FIGS. 1 and 2, an embodiment of the invention is embodied in an electrical connector 100. The electrical connector 100 includes an insulating body 10, a plurality of first terminals 20, a plurality of second terminals 30, a supporting body 40, a lid 50 and a shielding shell 60.

With reference to FIGS. 2 to 5, the insulating body 10 is an integral structure. A front end of a top surface of the insulating body 10 is concaved downward to form a pair of paths 11 of which each has an inclined rear inside connecting with the top surface of the insulating body 10. The inclined rear inside is designated as a guiding slope 111. A substantial middle of the top surface of the insulating body 10 sinks downward to form a locking cavity 12. A rear end of the locking cavity 12 is connected with the top surface of the insulating body by a locking slope 121. A rear of the insulating body 10 is concaved frontward to form a first receiving cavity 13. Two opposite sidewalls of the first receiving cavity 13 are concaved upward to form a pair of first gaps 141 and a pair of second gaps 142 adjacently behind the first gaps 141. Two opposite sidewalls of the insulating body 10 protrude downward to form a pair of lumps 16 at fronts thereof and are concaved inward to form two recesses 17 adjacently behind the lumps 16. Two opposite sidewalls of the insulating body 10 further define a pair of locking recesses 15 between the recesses 17 and the corresponding first gaps 141.

Each of the first terminals 20 has a first fastening strip 21, a first contact portion 22 and a first soldering portion 23 which are connected with two opposite ends of the first strip 21. The first soldering portion 23 is perpendicularly extended downward from a rear end of the first fastening strip 21. The first contact portion 22 is meandered frontward from a front end of the first fastening strip 21 to substantially show an S-shape.

Each of the second terminals 30 has a second fastening strip 31, a second contact portion 32 and a second soldering portion 33 which are connected with two opposite ends of the second fastening strip 31. The second soldering portion 33 is perpendicularly extended downward from a rear end of the second fastening strip 31. The second contact portion 32 is bent upward and then extended forward from a front end of the second fastening strip 31, with a front end thereof bent downward and then extending forward.

The supporting body 40 has a supporting portion 41 and a tongue board 42 protruding forward from a front face of the supporting portion 41. A rear of the tongue board 42 defines a plurality of containing slots 421 arranged at regular intervals along a transverse direction and each extending to the front face of the supporting portion 41. A plurality of partitions 422 each is protruded upward between each two adjacent containing slots 421 and adjacent to the supporting portion 41. Two opposite sidewalls of the supporting portion 41 are concaved inward to form a pair of inserting cavities 411 and protrude upward to form two second pillars 412 adjacently behind the inserting cavities 411. An outer bottom of a rear wall of each inserting cavity 411 of the supporting body 41 protrudes frontward to form a locking rib 413. A rear of the supporting portion 41 is concaved frontward to form a second receiving cavity 414. A rear end of each sidewall of the second receiving cavity 414 protrudes upward to form a third pillar 415 and protrudes downward to form a fourth pillar 416. Two insides of two opposite sidewalls of the second receiving cavity 414 protrude face-to-face to form a pair of first lumps 417 and two outsides of the two opposite sidewalls of the second receiving cavity 414 oppositely protrude outward to form a pair of second lumps 418. A bottom face of the supporting portion 41 protrudes downward to form a rectangular chunk 419 behind the locking ribs 413 and two opposite ends of the chunk 419 protrude downward to form a pair of positioning column 420.

The lid 50 has a rectangular positioning body 51 and a locking portion 52 protruding forward from a bottom of a front of the positioning body 51. A front of the locking portion 52 is concaved downward to form a third receiving cavity 521 of which a bottom wall defines a plurality of second positioning grooves 522 each penetrating vertically through the locking portion 52. Two opposite sides of the locking portion 52 define a pair of first fastening fillisters 523 and two opposite sides of the locking portion 52 oppositely protrude outward to form a pair of third lumps 524 at bottoms thereof. A front face of the positioning body 51 defines a plurality of first positioning grooves 511 each penetrating vertically through the positioning body 51. Two opposite sides of the positioning body 51 oppositely protrude outward to form a pair of fastening pillars 513. Two opposite sides of the fastening pillars 513 oppositely protrude outward to form a pair of fourth lumps 514. And a third gap 525 is defined between the fastening pillar 513 and the corresponding third lump 524.

The shielding shell 60 has a top plate 61, a bottom plate 62 and two side plates 63, which corporately define a receiving chamber (not labeled) for receiving the insulating body 10 and supporting body 40 therein. The top plate 61 and the side plates 63 are punched inward to form a plurality of elastic slices 631. A rear end of each side plate 63 of the shielding shell 60 is concaved frontward to form a second fastening fillister 632. The bottom edges of the rear ends of the side plates 63 are bent and extend inward to form a pair of fastening portions 633. The bottom edges of the rear ends of the side plates 63 are extend downward to form a pair of soldering tails 634.

Figure 3:
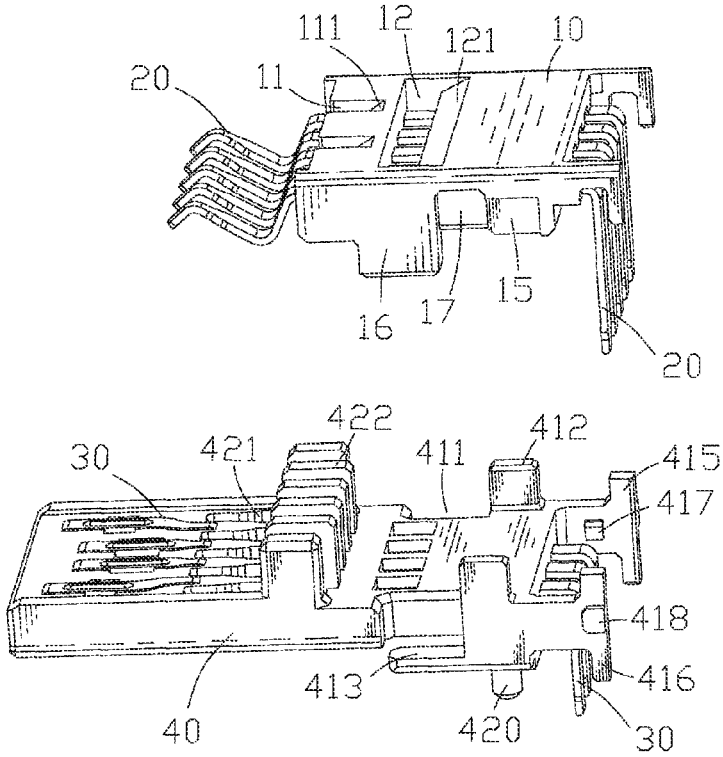
FIG. 3 is a perspective view of an insulating body with first terminals and a supporting body with second terminals of the electrical connector before assembly.
Figure 4:
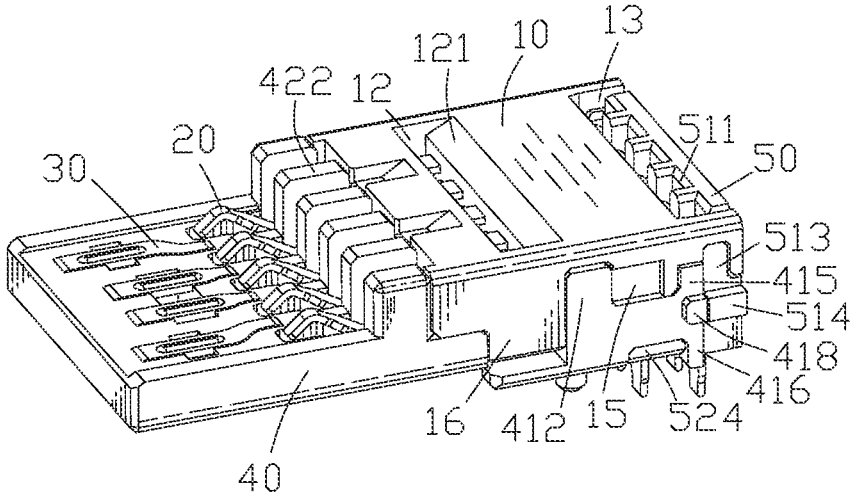
FIG. 4 is a perspective view of the electrical connector without a shielding shell shown in FIG. 1.
Figure 5:
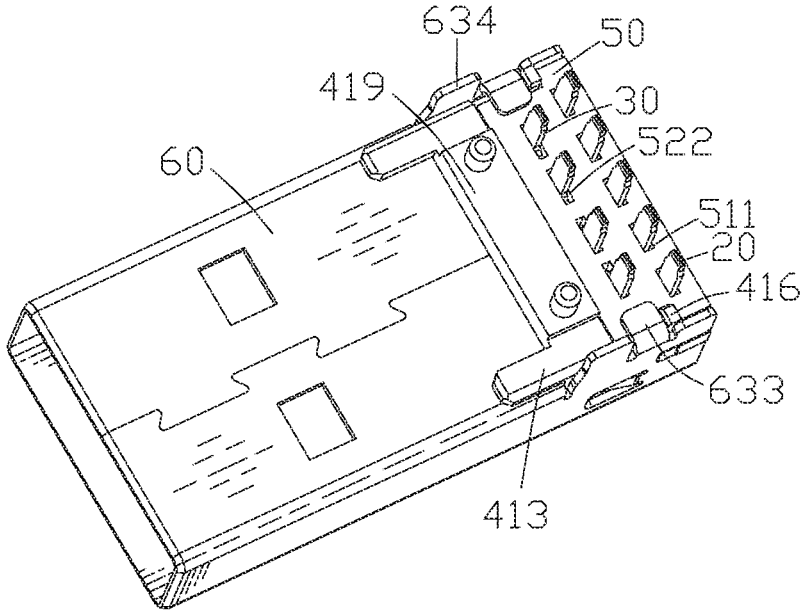
FIG. 5 is another perspective view of the electrical connector shown in FIG. 1.

Referring to FIGS. 3 to 5, the first terminals 20 are integrated in the insulating body 10 by virtue of the first fastening strips 21 being molded in the insulating body 10 and arranged at regular intervals along the transverse direction. The second terminals 30 are integrated in the supporting body 40 by virtue of the second fastening strips 31 being molded in the supporting body 40 and arranged at regular intervals along the transverse direction. The insulating body 10 is engaged on the supporting portion 41 and is blocked behind the partitions 422 of the supporting body 40. The first contact portions 21 of the first terminals 20 stretch in front of the insulating body 10 and are received in the containing slots 421 of the supporting body 40. The first soldering portions 23 of the first terminals 20 are vertically located in the first receiving cavity 13 and behind the second receiving cavity 414 with tail ends thereof further projecting beyond a bottom face of the supporting body 40. The second contact portions 31 of the second terminals 30 are exposed on the tongue board 42 and alternately arranged in front of the first contact portions 22 along the transverse direction. Front ends of the second contact portions 32 are embedded in the tongue board 42. The second soldering portions 33 of the second terminals 30 are vertically located in the second receiving cavity 414 with tail ends thereof further projecting beyond the bottom face of the supporting body 40. The first soldering portions 23 and the second soldering portions 33 are alternately arranged in two rows in longitudinal direction. The lumps 16 of the insulating body 10 are inserted in the inserting cavities 411 of the supporting body 40, and the second pillars 412 of the supporting body 40 are inserted in the recesses 17 of the insulating body 10.

Then, the lid 50 is mounted to the rears of the insulating body 10 and the supporting body 40. The locking portion 52 of the lid 50 is fixed in the second receiving cavity 414 of the supporting body 40. A top part of the positioning body 51 of the lid 50 is located in the first receiving cavity 13 of the insulating body 10. The first soldering portions 23 of the first terminals 20 and the second soldering portions 33 of the second terminals 30 are inserted in the first positioning grooves 511 and the second positioning grooves 522 respectively with the tail ends thereof projecting under the lid 50. At the same time, the third pillars 415 of the supporting body 40 are inserted in the first gaps 141 of the insulating body 10, the fastening pillars 513 of the positioning body 51 are inserted in the second gaps 142 and abut behind the third pillars 415. The first lumps 417 of the supporting body 40 are buckled in the first fastening fillisters 523 of the locking portion 52.

Lastly, the insulating body 10 with the first terminals 20, the supporting body 40 with the second terminals 30 and the lid 50 are inserted frontward in the shielding shell 60. The rear edge of the bottom plate 62 of the shielding shell 60 resists against the chunk 419, and the rear end of the bottom plate 62 is held by the locking ribs 413. The elastic slices 631 of the top plate 61 move along the paths 11 and slip over the guiding slopes 111 to be locked in the locking cavity 12 against the locking slope 121. The elastic slices 631 of the side plates 63 are buckled in the locking recesses 15 and front ends of the elastic slices 631 resist against the back surfaces of the second pillars 412. The second lumps 418 of the supporting body 40 and the corresponding fourth lumps 514 of the lid 50 are aligned with each other and buckled in the second fastening fillisters 632 of the shielding shell 60. The fastening portions 633 prop against the bottom face of the lid 50 and resist against the fourth pillars 416 of the supporting body 40.

As described above, the electrical connector 100 of the present invention not only has high signal transmission rate and miniaturized structure, but also can be assembled quickly and accurately, thus it saves a lot of manpower and material resources, reduces the production cost and further improves the production efficiency.

What is claimed is:

1. An electrical connector, comprising:

a supporting body having a supporting portion and a tongue board protruding frontward from a front face of the supporting portion, a rear of the tongue board defining a plurality of containing slots arranged at regular intervals along a transverse direction and each extending to the front face of the supporting portion, a rear of the supporting portion being concaved frontward to form a second receiving cavity;

an insulating body of which a rear is concaving frontward to form a first receiving cavity, the insulating body being engaged on the supporting portion of the supporting body;

a plurality of first terminals each having a first fastening strip, a first contact portion and a first soldering portion which are connected with two opposite ends of the first fastening strip;

a plurality of second terminals each having a second fastening strip, a second contact portion and a second soldering portion which are connected with two opposite ends of the second fastening strip; and a shielding shell enclosing the supporting body and the insulating body;

wherein the first terminals are integrated in the insulating body, the second terminals are integrated in the supporting body, the insulating body is engaged on the supporting body, the first fastening strips of first terminals are fixed in the first terminal grooves of the insulating body, the first contact portions of the first terminals are located in the first terminal containing slots of the supporting body, the first soldering portions of the first terminals are located behind the supporting body and the first soldering portions project downward beyond a bottom face the supporting body, the second fastening strips of the second terminals are fixed in the second terminal grooves of the supporting body, the second contact portions of the second terminals are exposed on the tongue board and arranged in front of the first contact portions, front ends of the second contact portions are embedded in the tongue board, the second soldering portions of the second terminals are located in the second receiving cavity and the second soldering portions project downward beyond a bottom face of the supporting body, the first and the second terminals are arranged in two rows in vertical direction and are arranged alternately at intervals in transverse direction with the first soldering portions and the second soldering portions are arranged in two rows in transverse direction and are arranged alternately at intervals in vertical direction.

2. The electrical connector as claimed in claim 1, wherein two opposite sidewalls of the insulating body protrude downward to form a pair of lumps at fronts thereof and are concaved inward to form two recesses adjacently behind the lumps, two opposite sidewalls of the supporting portion are concaved inward to form a pair of inserting cavities and protrude upward to form two second pillars adjacently behind the inserting cavities, a plurality of partitions each is protruded upward between each two adjacent containing slots and adjacent to the supporting portion, the insulating body is blocked behind the partitions, the lumps of the insulating body are inserted in the inserting cavities of the supporting body, and the second pillars of the supporting body are inserted in the recesses of the insulating body.

3. The electrical connector as claimed in claim 2, further comprising a lid which has a rectangular positioning body and a locking portion protruding forward from a bottom of a front of the positioning body, a front face of the positioning body defines a plurality of first positioning grooves each penetrating vertically through the positioning body, a front of the locking portion is concaved downward to form a third receiving cavity of which a bottom wall defines a plurality of second positioning grooves each penetrating vertically through the locking portion, the locking portion of the lid is fixed in the second receiving cavity of the supporting body, a top part of the positioning body of the lid is located in the first receiving cavity of the insulating body, the first soldering portions of the first terminals and the second soldering portions of the second terminals are inserted in the first positioning grooves and the second positioning grooves respectively with the tail ends thereof projecting under the lid.

4. The electrical connector as claimed in claim 3, wherein two insides of two opposite sidewalls of the second receiving cavity protrude face-to-face to form a pair of first lumps, two opposite sides of the locking portion define a pair of first fastening fillisters, the first lumps are buckled in the first fastening fillisters.

5. The electrical connector as claimed in claim 3, wherein two opposite sidewalls of the first receiving cavity are concaved upward to form a pair of first gaps and a pair of second gaps adjacently behind the first gaps, a rear end of each sidewall of the second receiving cavity protrudes upward to form a third pillar, two opposite sides of the positioning body oppositely protrude outward to form a pair of fastening pillars, the third pillars of the supporting body are inserted in the first gaps of the insulating body, the fastening pillars of the positioning body are inserted in the second gaps and abut behind the third pillars.

6. The electrical connector as claimed in claim 5, wherein the rear ends of the sidewalls of the second receiving cavity protrude downward to form two fourth pillars, two opposite sides of the locking portion oppositely protrude outward to form a pair of third lumps at bottoms thereof, a third gap is defined between the fastening pillar and the corresponding third lump, the fourth pillars of the supporting body are located in the third gaps of the locking portion.

7. The electrical connector as claimed in claim 5, wherein a front end of a top surface of the insulating body is concaved downward to form a pair of paths of which each has an inclined rear inside connecting with the top surface of the insulating body, the inclined rear inside is designated as a guiding slope, a substantial middle of the top surface of the insulating body sinks downward to form a locking cavity, a rear end of the locking cavity is connected with the top surface of the insulating body by a locking slope, the two opposite sidewalls of the insulating body further define a pair of locking recesses between the recesses and the corresponding first gaps, the shielding shell has a top plate, a bottom plate and two side plates, the top plate and the side plates are punched inward to form a plurality of elastic slices, the insulating body with the first terminals, the supporting body with the second terminals and the lid are inserted frontward in the shielding shell, the elastic slices of the top plate move along the paths and slip over the guiding slopes to be locked in the locking cavity against the locking slope, the elastic slices of the side plates are buckled in the locking recesses and front ends of the elastic slices resist against the back surfaces of the second pillars.

8. The electrical connector as claimed in claim 7, wherein an outer bottom of a rear wall of each inserting cavity of the supporting body protrudes frontward to form a locking rib, the bottom face of the supporting portion protrude downward to form a rectangular chunk behind the locking ribs, the rear edge of the bottom plate of the shielding shell resists against the chunk, and the rear end of the bottom plate is held by the locking ribs.

9. The electrical connector as claimed in claim 7, wherein two outsides of the two opposite sidewalls of the second receiving cavity oppositely protrude outward to form a pair of second lumps, two opposite sides of the fastening pillars oppositely protrude outward to form a pair of fourth lumps, a rear end of each side plate of the shielding shell is concaved frontward to form a second fastening fillister, the second lumps of the supporting body and the corresponding fourth lumps of the lid are aligned with each other and buckled in the second fastening fillisters of the shielding shell.

10. The electrical connector as claimed in claim 7, wherein the rear ends of the sidewalls of the second receiving cavity protrude downward to form two fourth pillars, bottom edges of rear ends of the side plates are bent and extend inward to form a pair of fastening portions, the fastening portions prop against the bottom face of the lid and resist against the fourth pillars.

* * * * *